United States Patent [19]

Collins

[11] 4,389,775

[45] Jun. 28, 1983

[54] BELT BUCKLE AND KNIFE

[76] Inventor: Walter W. Collins, 802 Bellwood St., Clover, S.C. 29710

[21] Appl. No.: 286,052

[22] Filed: Jul. 22, 1981

[51] Int. Cl.[3] ..... B26B 3/06; A45F 5/00

[52] U.S. Cl. ..... 30/156; 24/3 F; 24/163 K; 224/163; 30/151

[58] Field of Search ..... 30/151, 154, 155, 156, 30/158, 160–162, 125; 24/163 K, 3 F; 7/158; 224/163; 206/234, 349

[56] References Cited

U.S. PATENT DOCUMENTS

| | | | |
|---|---|---|---|
| 546,344 | 9/1895 | Prasse | 7/158 X |
| 1,508,963 | 9/1924 | Dorf | 24/163 |
| 1,614,949 | 1/1927 | Finley | 30/161 |
| 1,969,100 | 8/1934 | Segal . | |
| 2,162,654 | 6/1939 | Vaisey | 30/155 |
| 2,618,057 | 11/1952 | Gibson | 30/151 |
| 3,026,642 | 3/1962 | Ryan . | |
| 3,559,854 | 2/1971 | Loveland . | |
| 3,783,509 | 1/1974 | Lake | 30/161 |
| 3,823,421 | 7/1974 | Collins | 30/151 |
| 3,924,304 | 12/1975 | Grandmont | 24/163 K |
| 4,017,969 | 4/1977 | Stonebraker | 30/156 |
| 4,096,979 | 6/1978 | Collins | 224/163 |
| 4,313,230 | 2/1982 | Chovaniec | 30/162 X |

OTHER PUBLICATIONS

American Rifleman, "In My Arms Collection", Feb. 1954, pp. 26 & 27.

"How to Scrimshaw and Carve Ivory", Blackie Collins, ©1978, Knife World Books, Knoxville, Tennessee, p. 35.

*Primary Examiner*—James G. Smith
*Assistant Examiner*—Debra S. Meislin
*Attorney, Agent, or Firm*—Klarquist, Sparkman, Campbell, Leigh, Whinston & Dellett

[57] ABSTRACT

A knife and belt buckle case in which the knife is releasably secured to the buckle. The knife includes a blade pivoted to a handle by a pivot pin which has an eccentric head. With the knife open, the eccentric head is positioned for insertion through an aperture of the buckle as the blade is positioned within a blade receiving recess of the buckle. When the knife is closed, the inserted eccentric head engages the back surface of the buckle and releasably secures the knife to the buckle. The blade is threadably mounted to the pivot pin so that, as the knife is opened, the blade moves into frictional engagement with the handle and holds the knife open. Also, as the knife is closed, the blade moves toward the eccentric head and clamps a portion of the buckle between the head and blade to thereby tightly secure the knife to the case. A detent couples the handle to the buckle and prevents undesired opening of the handle.

16 Claims, 5 Drawing Figures

BELT BUCKLE AND KNIFE

BACKGROUND OF THE INVENTION

The present invention relates to a knife and case, and more particularly to a knife of the type with a blade pivoted to a handle and in which the knife is releasably secured to a case.

Typically, individuals must carry knives of the type in which a handle is pivoted to the blade in their pockets, where the knives are not readily accessible.

Also, individuals often carry knives of the fixed blade type hanging at their side in a sheath attached to their belt. Although somewhat more accessible, the knives cannot be easily reached by either hand.

Also, prior knives are typically not securely fastened to their sheathes or cases in a manner which minimizes the chances of the knives being lost.

Therefore, a need exists for a knife which solves these and other problems.

SUMMARY OF THE INVENTION

A knife of the type having a handle pivoted to a blade is disclosed, together with a special case which may comprise a belt buckle. The case defines a blade receiving recess. An attachment mechanism releasably secures the knife to the case when the blade is positioned in the blade receiving recess. This attachment mechanism comprises an eccentric head of a pivot pin which pivots the blade to the handle. The eccentric head is inserted through an aperture provided through case. When the handle is pivoted, the eccentric head pivots into engagement with the back surface of the case to thereby secure the knife to the case.

As a specific feature of the invention, the pivot pin is externally threaded and the blade is threaded onto the pin. Upon opening the knife, the blade moves toward and frictionally engages the handle to maintain the blade open. Also, when the blade is in the recess and the knife is closed, the blade moves toward the eccentric head and a portion of the case is clamped between the head and blade.

As another feature of the invention, the aperture and eccentric head are generally of a semicircular shape.

As a further feature of the invention, the blade receiving recess is provided in a central portion of the case, the central portion raised so that, as the handle is pivoted, clearance exits between the handle and remainder of the case.

As still another feature of the invention, when the knife is closed, a detent mechanism couples the handle to the case and minimizes the chance of the knife opening at undesired times.

As a further feature of the invention, a stop mechanism is provided for establishing the open and closed positions of the knife.

As a still more specific feature of the invention, the case is generally rectangular and the recess is defined along a diagonal of the case.

It is an overall object of the invention to provide an improved knife and case;

It is a further object of the invention to provide a knife and belt buckle case.

It is another object of the invention to provide a knife of the folding blade type which is carried in a case and which is readily accessible for use.

A further object of the invention is to provide a knife which an individual can open and remove from its case using either hand.

Another object of the invention is to provide a knife which is safer to use.

Still another object of the invention is to provide a knife which is mechanically simple and easy to manufacture.

These and other features, advantages and objects of the invention will become more apparent with reference to the following description and drawings.

DETAILED DESCRIPTION OF THE PREFERRED EMBODIMENT

Figure 1:
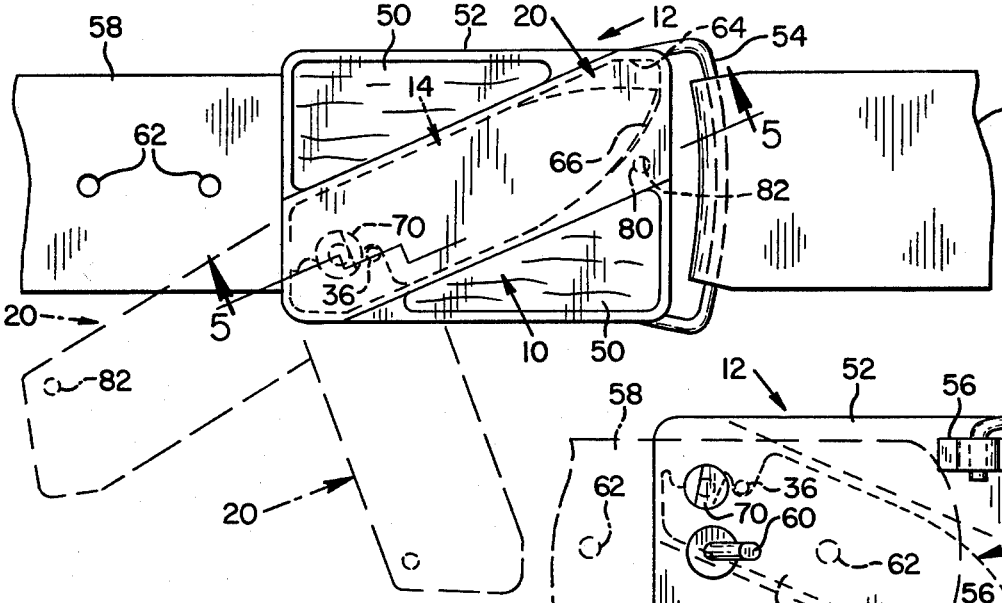
FIG. 1 is a front view of a knife and case of the invention, with the knife handle illustrated in a closed position by solid lines and in various open positions by dashed lines.

With reference to FIGS. 1–4, the preferred embodiment of a knife 10 and case 12 is illustrated. The knife includes a blade 14 having first and second blade side surfaces 16, 18 and a handle 20 with first and second handle side surfaces 22, 24. The shank end 26 of the blade 14 is pivoted to an end 28 of the handle by a pivot pin 30. As a result, handle 20 is movable relative to the blade between open and closed positions. When in an open position shown in FIG. 4, the free end or tip 32 of the blade extends away from the free end 34 of the handle. In contrast, when in a closed position, shown in solid lines in FIG. 1, the handle 20 overlays the blade 12 with the respective first side surfaces 16, 22 of the blade and handle positioned adjacent to one another. Handle side surface 22 and the shank end of blade side surface 16 are preferably planar to facilitate relative sliding of these members.

Figure 2:
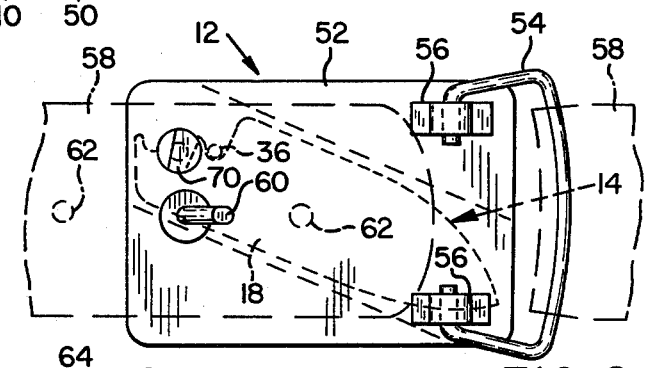
FIG. 2 is a back view of the knife and case of FIG. 1.
Figure 3:
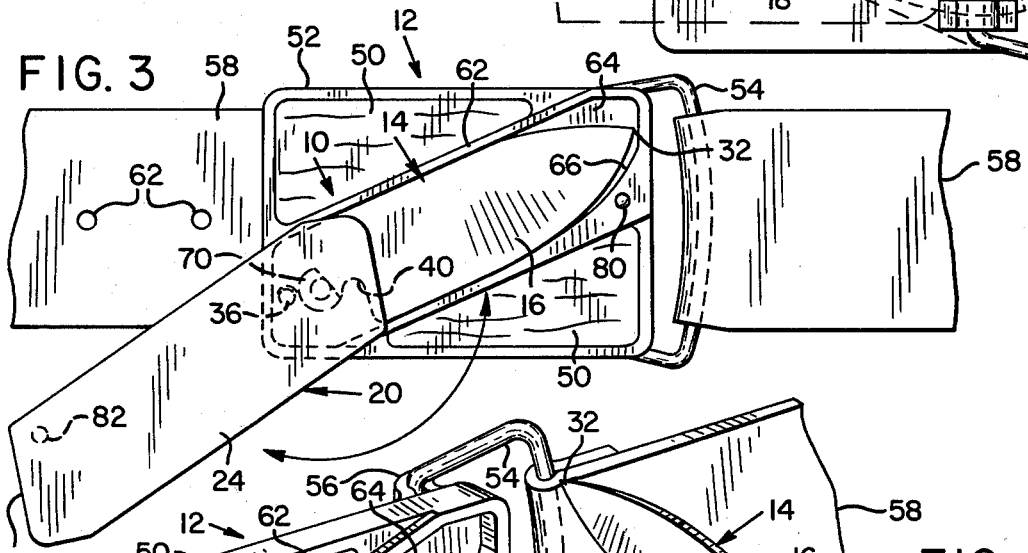
FIG. 3 is a front view of a knife and case of FIG. 1, with the knife handle shown in a fully opened position.
Figure 4:
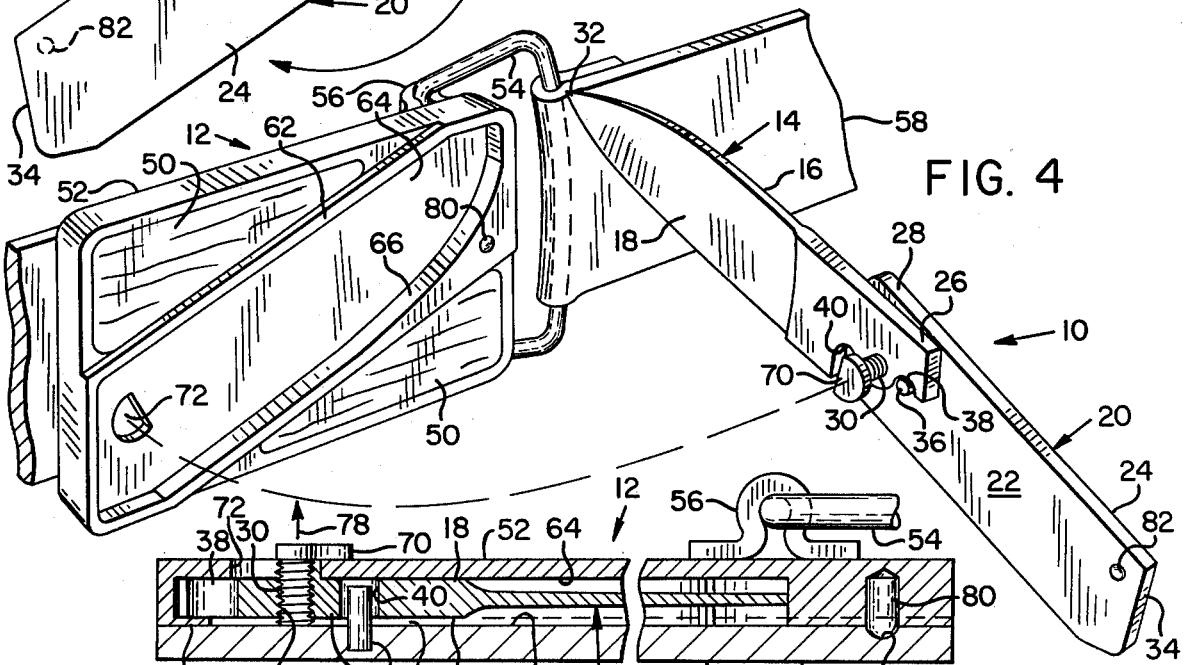
FIG. 4 is a perspective view of a knife and case of the invention, with the knife removed from the case.

A stop means is provided for limiting the pivoting of the blade relative to the handle to establish the maximum open and closed positions. Such a means may comprise a pin 36 projecting outwardly from the first handle side surface 22 at a position between the pin 30 and the handle free end 34. The blades 14 includes a first curved stop engaging portion 38 which is located at the opposite side of pivot pin 30 from the tip 32 of the blade. Stop engaging portion 38 engages pin 36, as shown in FIG. 4, to limit opening of the knife. In addition, blade 14 includes a second curved top engagement portion 40, located at the same side of the pin 30 as the blade tip 32. As can be seen in FIGS. 1 and 2, second stop engagement portion 40 engages pin 36 and limits closing of the knife.

Figure 5:
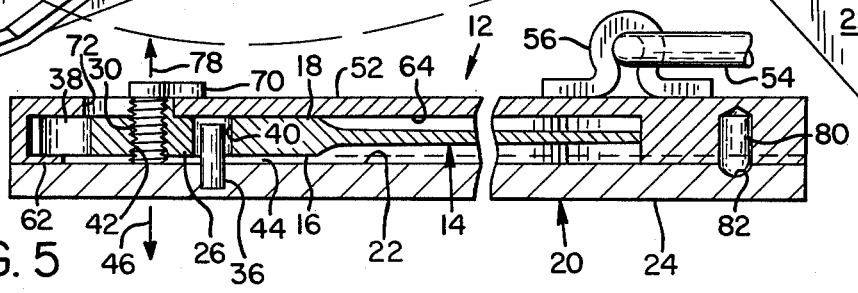
FIG. 5 is a cross-sectional view of the knife and case of the invention, taken along lines 5—5 of FIG. 1.

Also, as best seen in FIG. 5, an internally threaded pivot opening 42 is provided through the shank 26 of the blade 14. In addition, the pin 30 is externally threaded and extends through pivot opening 42 to thereby threadably mount the blade to the pin. A gap 44 is provided between blade side surface 16 and handle side surface 22 when the handle is in a closed position. As the handle is moved to an open position, the blade 14 moves in the direction of arrow 46 toward the handle 20. When the blade and the handle approach the maximum open position, the blade side surface 16 and handle side surface 22 bear against one another. This frictional contact between these surfaces maintains the blade in an open position and prevents the knife from folding closed during use.

The case 12 comprises a belt buckle having a front surface 50 and a back surface 52. Referring to FIG. 2, a belt loop 54 is mounted by fasteners 56 to the back surface 52 of the case and a belt 58 is fastened to loop 54 in a suitable manner. Also, a hook 60 is mounted to the back surface 52 of the case and is inserted through belt openings 62 to buckle the belt.

As best seen in FIG. 4, case 12 is generally rectangular. The front surface 50 of the case includes a diagonal central band 62 which is raised relative to the remainder of the front surface. The band defines a blade receiving recess 64 which is of depth and shape to receive the blade 14. Referring to FIG. 5, when the blade is positioned in the recess, the handle 20 is positioned outside thereof so that it may be pivoted relative to the retained blade. The walls 66, which bound the recess 64, retain the blade as the handle is pivoted. Also, because the band 62 is raised, a clearance is provided between the non-raised portions of the front surface 50 and the handle.

An attachment means is provided for releasably securing the knife to the case. Referring more particularly to FIGS. 4 and 5, the pin 30 is formed with an eccentric, truncated circular head 70. When the opened blade 14 is positioned in the recess 64, the pin 30 extends through a truncated circular opening 72 through the case, see FIG. 5. The head 70 is spaced from the surface 18 of the blade shank 26 a distance just slightly greater than the distance between the surface 52 and the bottom of the recess 64. Thus, when the knife handle 20 is rotated to closed position, the head 70 is rotated away from the opening 72 so as to engage the surface 52 and secure the knife in the case, see FIG. 5.

With reference to FIG. 5, as the handle 20 is moved to the closed position, blade 14 shifts in the direction of arrow 78 because of its threaded mounting. That is, the space between the head 70 and blade 14 narrows as the knife is closed so that when the knife is fully closed, the case 12 is wedged snugly between the head 70 and the blade shank 26. As a result, the knife is snugly clamped to the case.

Means are provided for releasably securing the handle in a closed position. The illustrated means comprises a detent 80 projecting outwardly from the band 62 and which, when the knife is closed, is positioned in a detent opening 82 in the handle side surface 22. The detent resists opening of the handle until the handle is manually manipulated.

Having illustrated and described the principles of my invention with reference to a preferred embodiment, it should be apparent to those skilled in the art that the invention may be modified in arrangement and in detail without departing from such principles. Therefore, I claim as my invention, a knife and case which falls within the true scope and spirit of the following claims:

I claim:

1. A knife and case comprising:

a knife blade having first and second side surfaces;

a handle pivoted to one end of said blade for pivoting from a closed position in which the handle overlays the first side surface of said blade to an open position in which the free end of the handle extends away from the free end of the blade;

a case, said case including blade receiving means for receiving the blade when the handle is in the open position and for permitting pivoting of the handle relative to the received blade;

attachment means for securing the received blade to said case upon pivoting the handle from the open to closed positions and for releasing the received blade from the case upon pivoting the handle from the closed to open positions, to thereby releasably secure the knife to the case.

2. An apparatus according to claim 1 in which said case includes a front surface and said blade receiving means comprises walls which define a blade receiving recess in the front surface of said case.

3. An apparatus according to claim 1 in which said case comprises a belt buckle and includes means for connecting said buckle to a belt, and said attachment means comprises means for securing and releasing the knife from the buckle while the buckle is worn.

4. A knife and case comprising:

a knife blade having first and second blade side surfaces;

a handle having first and second handle side surfaces;

pivot means for pivoting one end of said handle to one end of said blade, such that said handle is pivotable about a pivot axis from a closed position, in which the first handle side surface overlays the first blade side surface, to an open position, in which the free end of the handle extends away from the free end of the blade;

a case having front and back surfaces, the front surface defining a knife blade shaped recess, the recess being sized for receiving the blade with the second blade side surface positioned adjacent the recessed portion of the front surface and with the handle positioned outside the recess, thereby permitting pivoting of the handle relative to the blade received within the recess;

eccentric means carried by said handle and pivotable about said pivot axis as said handle is pivoted between the open and closed positions;

said case including eccentric engagement means for receiving said eccentric means upon positioning said blade within the recess with the handle in an open position, said eccentric engagement means comprising means for engaging said eccentric means to secure the received blade to the case upon pivoting the handle from the open position to the closed position and means for disengaging said eccentric means to release the received blade from the case upon pivoting the handle from the closed to the open position, to thereby releasably secure the knife to the case.

5. An apparatus according to claim 4 in which said pivot means comprises a pivot pin projecting outwardly from the first handle side surface, said blade defining a pivot opening through which the pivot pin is inserted to pivot the blade to the handle with the first blade side surface adjacent the first handle side surface, and in which said eccentric means comprises an eccentric head of said pivot pin.

6. An apparatus according to claim 5 in which an aperture is provided through the case communicating from the recessed portion of the front surface to the back surface of the case, said eccentric engagement means comprising a head engagement portion of said back surface bounding the aperture, said blade being mounted to said pivot pin so as to provide a space between the second blade side surface and the eccentric head, the pin being of a length such that the space is greater than the distance between the recessed portion of the front surface and the head engagement portion of the back surface, the aperture being sized larger than said eccentric head to permit insertion of the eccentric head through the aperture upon positioning of the blade within the recess with the handle in the open position, the aperture also being sized such that pivoting of the handle to the closed position, from such open position with the blade within the recess, pivots the eccentric head into engagement with the head engagement portion of the back surface and thereby releasably secures the knife to the case.

7. An apparatus according to claim 6 in which said pivot pin is externally threaded and in which said blade defines an internally threaded pivot opening, said blade being threadably mounted to said pivot pin.

8. An apparatus according to claim 6 or 7 in which said eccentric head is of a truncated circular shape and said aperture is of a truncated circular shape.

9. An apparatus according to claim 4 including means for resisting the movement of the handle from the closed to open positions.

10. An apparatus according to claim 7 including a detent projecting outwardly from the front surface of said case and a detent opening defined by the first handle side surface, said detent and detent opening releasably coupling said handle to said case upon positioning of the handle in a closed position with the blade within the recess.

11. An apparatus according to claim 10 in which said handle includes a stop projecting outwardly from the first surface of the handle and positioned between said pivot pin and the free end of the handle, said blade including a first stop engaging position positioned at the opposite side of the pivot pin from the free end of the blade, said first stop engaging portion being positioned so as to engage said stop to limit pivoting of the blade relative to the handle in a direction which opens the handle and blade, said blade including a second stop engaging portion positioned at the same side of the pivot pin as the free end of the blade, said second stop engaging portion being positioned so as to engage said stop to limit pivoting of the blade relative to the handle in a direction which closes the handle and blade.

12. An apparatus according to claim 4 including stop means for limiting the pivoting of said blade relative to the handle to establish the open and closed positions.

13. An apparatus according to claim 4 or 7 in which pivoting of said blade in a first direction relative to said handle moves the first blade side surface toward and into frictional engagement with the first handle side surface.

14. An apparatus according to claim 13 in which said first direction is toward an open position of the handle.

15. An apparatus according to claim 14 including stop means for limiting the pivoting of said blade relative to said handle in a direction opposite said first direction.

16. A knife and belt buckle comprising:

a knife blade having first and second blade side surfaces and defining an internally threaded pivot opening:

a handle having first and second planar handle side surfaces;

an externally threaded pivot pin projecting outwardly from said handle first side surface and extending through the pivot opening to pivot one end of said handle to one end of said blade, such that said handle is pivotable about a pivot axis from a closed position, in which the first handle side surface overlays the first blade side surface, to an open position, in which the free end of the handle extends away from the free end of the blade;

a generally rectangular belt buckle having front and back surfaces, the front surface having a raised diagonally positioned band with the band defining a knife blade shaped recess, the recess being sized for receiving the blade with the second blade side surface positioned adjacent the recessed portion of the front surface and with the handle positioned outside the recess, thereby permitting pivoting of the handle relative to the blade received within the recess;

said pivot pin including an eccentric head which is pivotable about said pivot axis as said handle is pivoted between the open and closed positions;

said buckle defining an aperture which communicates from the recessed portion of the front surface to the back surface of the buckle, the aperture being positioned to receive the eccentric head upon positioning said blade within the recess with the handle in an open position, said back surface of the buckle including an eccentric head engagement portion which partially bounds the aperture, said eccentric head engagement portion being positioned to engage the eccentric head and to secure the received blade to the buckle upon pivoting the handle from the open position to the closed position and to disengage said eccentric head to release the received blade from the handle upon pivoting the handle from the closed position to the open position, to thereby releasably secure the knife to the buckle.

* * * * *